US006244980B1

(12) United States Patent
Depcik

(10) Patent No.: US 6,244,980 B1
(45) **Date of Patent: *Jun. 12, 2001**

(54) THROWING AND HITTING SPORTS TOY

(76) Inventor: David F. Depcik, 1216 Fox Trail Ct., Naperville, IL (US) 60540

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 232 days.

(21) Appl. No.: 08/880,533

(22) Filed: Jun. 23, 1997

(51) Int. Cl.[7] ..... A63B 65/00
(52) U.S. Cl. ..... 473/613
(58) Field of Search ..... 473/569, 578, 473/579, 595, 613, 614, 615; D7/509, 523

(56) References Cited

U.S. PATENT DOCUMENTS

D. 259,757 * 7/1981 Perrin ..... D7/509
D. 259,846 * 7/1981 Perrin ..... D7/509
D. 282,134 * 1/1986 Durand ..... D7/523
D. 297,090 * 8/1988 West ..... D7/523
D. 317,100 * 5/1991 Unger ..... D7/509
D. 321,813 * 11/1991 Unger ..... D7/509
2,683,603 * 7/1954 Gackenbach ..... 473/613
3,363,820 * 1/1968 Schilling ..... D7/523
4,184,682 * 1/1980 Collins et al. ..... 473/613
4,687,210 * 8/1987 Michel ..... 473/595
4,955,620 * 9/1990 Reinke ..... 473/613
5,306,191 * 4/1994 Phillips et al. ..... 473/613

* cited by examiner

*Primary Examiner*—Steven Wong
(74) *Attorney, Agent, or Firm*—Breiner & Breiner

(57) ABSTRACT

A substantially cup-shaped throwing and hitting sports toy is provided having a flared open end portion, a body portion, and a closed end portion. The structure of the toy provides for various flight patterns while being suitable for use in limited areas of space.

4 Claims, 2 Drawing Sheets

PLAN VIEW
HITTER
SCREWBALL
PITCHER

PLAN VIEW
HITTER
DOUBLE CURVE
PITCHER

PLAN VIEW
HITTER
CURVE
PITCHER

SIDE VIEW
HITTER
DROP
PITCHER

THROWING AND HITTING SPORTS TOY

FIELD OF THE INVENTION

The invention is directed to throwing and hitting sports toys, particularly suitable for use in throw and hitting baseball-type games.

BACKGROUND OF THE INVENTION

Sporting activities involving throwing, catching, and/or hitting a thrown or flying object have become a popular pastime. Many types of balls and objects are known for use in sporting activities involving bats, such as baseballs, softballs, and "balloon" balls. Yet other balls and objects exist for striking with a flat surfaced article like a racket or paddle, such as tennis balls and badminton shuttlecocks. Further, many variations exist in the compositions and coverings of such balls or objects that may affect the aerodynamics, safety of use, durability, hardness, resiliency, elasticity, etc. of the balls or objects.

Balls used in baseball-type games often travel great distances in the air after being hit by a bat. Additionally, when a ball is hit and lands it often rolls an additional distance. The result is that it is often difficult to confine such baseball-type games to restricted areas such as an indoor gym or residential yard. Furthermore, it is difficult to practice batting absent vast areas of open space or netting to catch and retrieve balls.

A need exists for a throwing and hitting sports toy that is not a ball, that is resilient when hit by a bat, paddle, racket, stick or other similar hitting device, that is safe for use by children, that does not fly as far as a ball when hit, that is suitable for confined areas such as indoor gyms and residential yards, that is easy to throw, that exhibits differing flight patterns depending on how it is thrown, and that does not roll significant distances after it lands.

The foregoing illustrates limitations known to exist in conventional throwing and hitting toys. Thus, it is apparent that it would be advantageous to provide an improved throwing and hitting toy directed to overcoming the limitations set forth above. Accordingly, the present invention provides a suitable alternative including features more fully disclosed hereinafter.

OBJECTS AND BRIEF DESCRIPTION OF THE INVENTION

The present invention advances the art of throwing and hitting sports toys beyond which is known to date. In one aspect of the present invention, a cup-like throwing and hitting toy is provided having a flared open end portion, a body portion, and a closed end portion.

It is, therefore, a primary object of the present invention to provide a throwing and hitting toy that meets one or more of the aforementioned needs relating to throwing and hitting toys.

It is a further object of the present invention to provide a throwing and hitting toy which is substantially cup-shaped that can be used in baseball-type throwing and hitting games.

DESCRIPTION OF THE DRAWINGS

The foregoing summary, as well as the following detailed description of preferred embodiments of the invention, will be better understood when read in conjunction with the appended drawings. For purposes of illustrating the invention, there is shown in the drawings embodiments which are presently preferred. It should be understood, however, that the invention is not limited to the precise arrangement and instrumentality shown. In the drawings.

DETAILED DESCRIPTION OF PRESENTLY PREFERRED EMBODIMENTS

Figure 1:
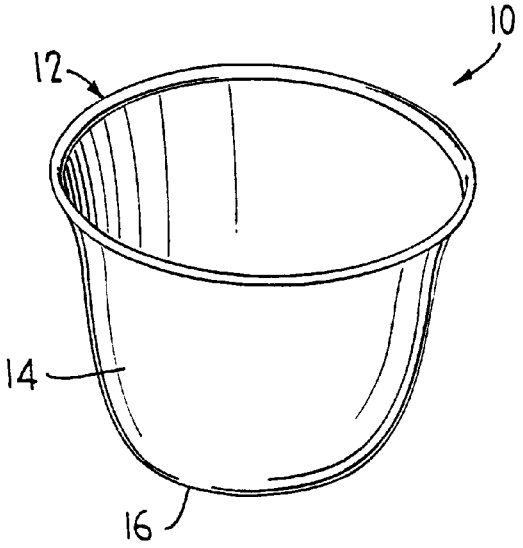
FIG. 1 is a perspective view of the present invention.

Referring to the drawings, wherein similar reference characters designate corresponding parts throughout the several views, the throwing and hitting sports toy of the present invention is generally illustrated at 10 in FIG. 1. The throwing and hitting toy is substantially cup-shaped and includes generally a flared open end portion 12, a body portion 14, and a closed end portion 16.

Figure 2:
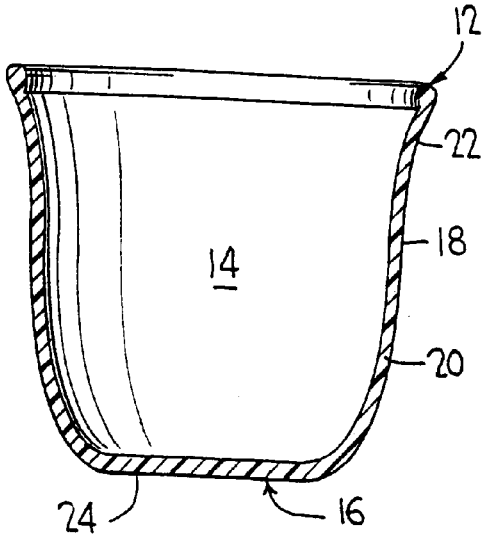
FIG. 2 is a cross sectional side view of one embodiment of the present invention.
Figure 4:
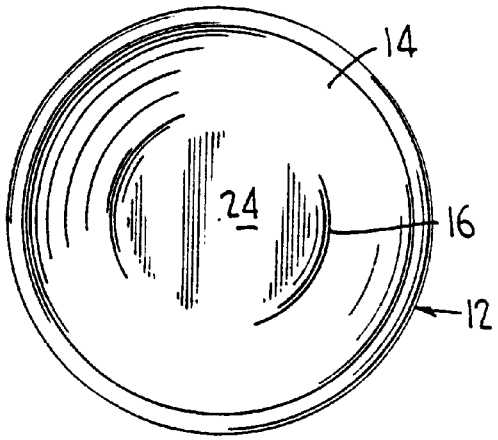
FIG. 4 is a top plan view of the present invention.
Figure 5:
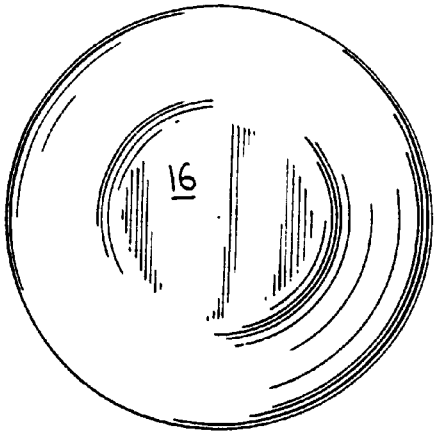
FIG. 5 is a bottom plan view of the embodiment of the present invention shown in FIG. 2.

Turning to FIG. 2, the body portion 14, generally cylindrically shaped and analogous to the sidewalls of a cup, has a top end 18 and a bottom end 20. The top end 18 merges into a flared rim portion 22. FIG. 4 shows a top view of the invention looking into the flared open end 12. The bottom end 20 terminates generally at the closed end portion 16. The flared rim is of a greater circumference than the body portion 14 and is one aspect which can affect the flight pattern of the invention. The closed end portion 16, in the embodiment depicted in FIG. 2, has a substantially planar bottom portion 24 that is of similar thickness to that of the body portion 14. A bottom view of the embodiment of FIG. 2 is shown in FIG. 4.

Figure 3:
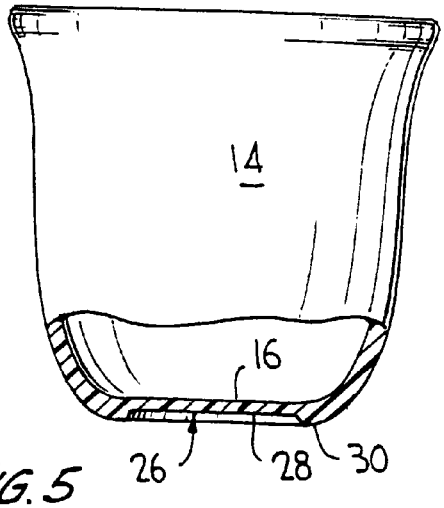
FIG. 3 is a partial cut-away view of another embodiment of the present invention.
Figure 6:
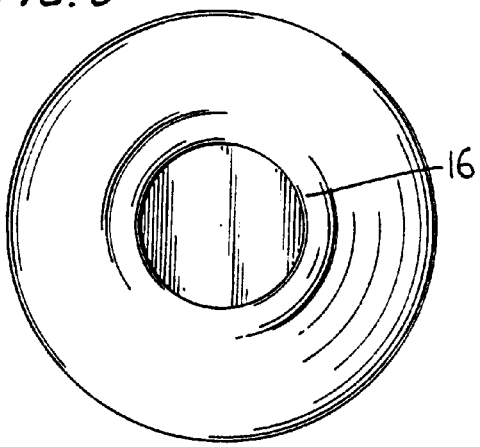
FIG. 6 is a bottom plan view of the embodiment of the present invention shown in FIG. 3.

FIG. 3 displays an alternate embodiment of the invention wherein the closed end portion 16 has an indented bottom portion 26 wherein the flat planar wall portion 28 thereof has a thickness less than a bottom rim portion 30. A bottom view of FIG. 3 is shown in FIG. 6. The bottom rim portion 30 can be of any thickness so long as it is greater than that of the wall portion 28. Because one end of the invention is open and the other end closed, the weight distribution is greater near the closed end. When the invention is thrown, the weight distribution and the aerodynamics of the invention result in rotation, flipping, or turning of the invention such that the closed end portion 16 is the lead end in flight. Because it is contemplated that the invention will be struck by the ground, a bat, a paddle, or the like in baseball-type games, the closed end 16 needs to be resilient enough to withstand typical impact forces. A bottom rim portion 30 of increased thickness may be used to provide additional resiliency.

The closed end portion 16 can be tapered from the body portion or rounded to provide increased aerodynamic characteristics.

The invention may be formed of any suitable plastic, elastomer, urethane, rubber or other material depending on desired overall weight, resiliency, strength, durability, elasticity, or other desired characteristics.

Though overall size and dimension of the constituent parts of the invention may vary with respect to the intended use of the toy, the overall size is generally that of a major league baseball in view of the nature of the games the toy will be used in, the ability to comfortably hold and throw the ball, and to better allow for the desired curves and pitch action. In one preferred embodiment the diameter of the body portion 14 is about 2.0–2.5 (in particular about 2.4) inches, the diameter of the flared open end is about 3.0 inches, the wall thickness is constant at about 0.05 inches, and the overall height from top to bottom is about 2.5–3.0 (in particular about 2.6) inches. These sizes can necessarily be modified in view of the desired play and material used to produce the toy. For example, depending upon the strength and flexibility of the material used to make the toy, the wall thickness, in particular in relation to the bottom closed wall, may be increased or decreased. Size and shape refinements of the invention can be provided such that the toy retains its intended use characteristics as a throwing and hitting toy having the advantages as set forth above.

Figures 7A, 7B, 7C, 7D:
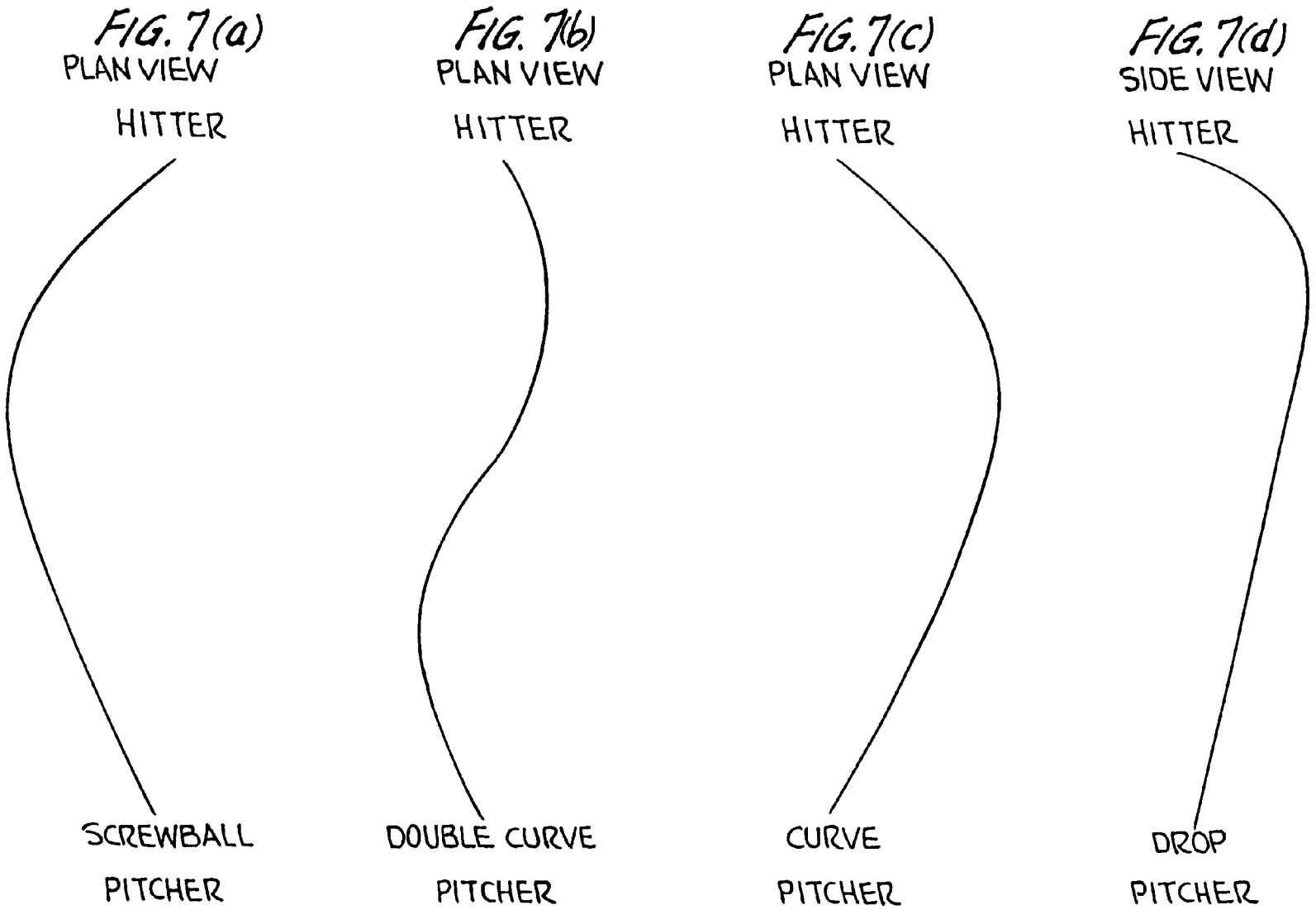
FIGS. 7(*a*) to 7(*d*) are views of flight patterns exhibited by the present invention when the toy is thrown.

Due to the aerodynamics provided by the invention, particularly due to the weight distribution and flared open end, the invention when thrown with varying spin, velocity, and position can exhibit flight patterns such as shown in FIGS. 7(*a*), 7(*b*), 7(*c*) and 7(*d*). This provides the toy with features that allow for the development of skill and thus competitive ability in the use of the toy.

The invention is particularly suitable for use in a game having rules similar to those of baseball and can be flexible depending on the skill and number of players. The game can include innings and outs. Hits can be determined according to conventional baseball rules, or if a limited number of players are present (such as two), markers can be used to designate whether a hit would be considered a single, double, triple or a home run. Outs are then based on a strikeout or if the toy is caught on the fly or before it passes a designated marker. Distances for pitching and hitting purposes will be based on the skill of the players and the field. For example, children 10 and under usually find distances of 30 feet or less work well. Older children and adults may start with pitching distances of 40 feet and adjust as necessary. Various hitting devices can be used. The size and shape of the hitting surface can be determined by the ability of the player, i.e., larger hitting surfaces for younger or less skillful players.

Thus, the invention allows for variation in play and is adaptable to the skill and competitiveness of the players, as well as to the playing field available.

As will be apparent to one skilled in the art, various modifications can be made within the scope of the aforesaid description. Such modifications being within the ability of one skilled in the art form a part of the present invention and are embraced by the appended claims.

It is claimed:

1. A throwing and hitting toy comprising a body portion, an outwardly flared open end portion, and a closed end portion, wherein the body portion, the flared open end portion and the closed end portion are constructed and arranged to provide a substantially cup-shaped elastically flexible toy capable of being thrown or hit while maintaining structural integrity, and has a weight distribution such that weight of the toy is greater at the closed end portion so that said weight distribution and aerodynamics provide variable flight patterns for the toy upon throwing, said body portion having a substantially flat body wall portion extending circumferentially around said body portion to provide a hand grip and throw control area for the toy such that length of the toy is greater than width of the hand grip and throw control area.

2. The toy of claim 1 wherein the closed end portion includes a substantially planar wall.

3. The toy of claim 1 wherein the closed end portion includes an indented wall portion.

4. The toy of claim 1 wherein the throwing and hitting toy is constructed from a material selected from a group consisting of plastic, elastomer, urethane, and rubber.

* * * * *